US008498439B2

(12) United States Patent
Bae et al.

(10) Patent No.: US 8,498,439 B2
(45) Date of Patent: Jul. 30, 2013

(54) HEADSET FOR USER SPECIFIC AUDIO SERVICE AND METHOD FOR USER SPECIFIC AUDIO SERVICE USING THE SAME

(75) Inventors: Chang Seok Bae, Daejon (KR); Jong Ho Won, Daejon (KR)

(73) Assignee: Electronics and Telecommunications Research Institute, Daejon (KR)

( * ) Notice: Subject to any disclaimer, the term of this patent is extended or adjusted under 35 U.S.C. 154(b) by 783 days.

(21) Appl. No.: 12/664,710

(22) PCT Filed: Dec. 12, 2007

(86) PCT No.: PCT/KR2007/006459

§ 371 (c)(1),
(2), (4) Date: Dec. 15, 2009

(87) PCT Pub. No.: WO2009/014286

PCT Pub. Date: Jan. 29, 2009

(65) Prior Publication Data

US 2010/0183183 A1 Jul. 22, 2010

(30) Foreign Application Priority Data

Jul. 20, 2007 (KR) ..... 10-2007-0072913

(51) Int. Cl.
*H04R 25/00* (2006.01)

(52) U.S. Cl.
USPC ..... 381/370; 381/371; 381/384

(58) Field of Classification Search
USPC ..... 381/309, 72, 74, 122, 370, 371, 374, 381/384, 17
See application file for complete search history.

(56) References Cited

U.S. PATENT DOCUMENTS

| | | | | |
|---|---|---|---|---|
| 5,422,956 | A | 6/1995 | Wheaton | |
| 7,418,103 | B2 * | 8/2008 | Sargaison | 381/74 |
| 7,502,477 | B1 * | 3/2009 | Inanaga et al. | 381/17 |
| 2006/0233413 | A1 | 10/2006 | Nam | |

FOREIGN PATENT DOCUMENTS

| | | | |
|---|---|---|---|
| JP | 12-032581 | A | 1/2000 |
| JP | 17-037649 | A | 2/2005 |

OTHER PUBLICATIONS

International Search Report: PCT/KR2007/006459.

* cited by examiner

*Primary Examiner* — Huyen D Le
(74) *Attorney, Agent, or Firm* — Ladas & Parry LLP

(57) ABSTRACT

Provided are a headset for a user specific audio service and a method for a user specific audio service using the same. The headset for a user specific audio service includes: a sensing unit sensing whether or not the headset is put on; an information collecting unit determining whether or not the headset is put on by the sensing unit and collecting current situation information of a user when the headset is put on; and an information processing unit generating a user profile based on the current situation information of the user, and controlling an audio signal output of a digital audio device based on the generated user profile.

15 Claims, 2 Drawing Sheets

HEADSET FOR USER SPECIFIC AUDIO SERVICE AND METHOD FOR USER SPECIFIC AUDIO SERVICE USING THE SAME

TECHNICAL FIELD

The present invention relates to a headset, and more particularly, to a headset for a user specific audio service that automatically provides a user preferred audio service without user's particular intervention or selection, and a method for a user specific audio service using the same.

BACKGROUND ART

A headset such as a stereo headphone for listening to music has been used for a long time together with a hearing aid, a portable radio, etc, and lately, a portable headset of a new form is developed for mobile phones or other portable electronic devices. Especially, most of the latest headsets include a wireless headset with Bluetooth function, etc.

However, according to a music listening environment through typical wireless headsets and digital audio devices, a user wears a headset and turns on a digital audio device, and then selects music for listening.

That is, a user needs to select his/her preferred music for listening and this requires user's intervention for playing and stopping music.

Furthermore, a user determines his/her current position or state to manually select and play his preferred music. Furthermore, several music files are connected together and managed in one folder or as a music list for playing. For this music managing method, user's intervention is required.

DISCLOSURE OF INVENTION

Technical Problem

Accordingly, the present invention is directed to a headset for a user specific audio service and a method for a user specific audio service using the same, which substantially obviates one or more problems due to limitations and disadvantages of the related art.

It is an object of the present invention to provide a headset for user specific audio service that understands user's intension for music and recognizes user's current state to automatically play the optimized music, and a method for user specific audio service using the same.

Technical Solution

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, there is provided a headset for a user specific audio service, including: a sensing unit sensing whether or not the headset is put on; an information collecting unit determining whether or not the headset is put on by the sensing unit and collecting current situation information of a user when the headset is put on; and an information processing unit generating a user profile based on the current situation information of the user, and controlling an audio signal output of a digital audio device based on the generated user profile.

The headset further may include a wireless communication unit performing wireless communication.

The sensing unit may include one of a temperature sensing unit, a light sensing unit, an acceleration sensing unit, a gyro sensing unit, a pressure sensing unit, a skin conductivity sensing unit, and a pulse sensing unit.

The information collecting unit may be mounted on the digital audio device.

The information collecting unit may include at least one of a temperature sensing unit, a light sensing unit, an acceleration sensing unit, a gyro sensing unit, a pressure sensing unit, a skin conductivity sensing unit, and a pulse sensing unit.

The user profile may include types or lists of specific situation audio that the user prefers.

In another aspect of the present invention, there is provided a method for a specific user audio service by using a headset, the headset outputting music appropriate for a user through wireless communication between the headset and a digital audio device, the method comprising the steps of: determining whether or not the user wears the headset; searching the digital audio device when the user wears the headset; collecting current situation information of the user when the digital audio device is detected; analyzing a user profile based on the collected current situation information of the user; and providing the user specific audio service based on the analyzed user profile.

The current situation information of the user may include at least one of a temperature sensing unit, a light sensing unit, an acceleration sensing unit, a gyro sensing unit, a pressure sensing unit, a skin conductivity sensing unit and a pulse sensing unit.

The user profile may include types or lists of specific situation audio that the user prefers.

It is to be understood that both the foregoing general description and the following detailed description of the present invention are exemplary and explanatory and are intended to provide further explanation of the invention as claimed.

Advantageous Effects

The present invention provides units mounted on a wireless headset or a digital audio device for analyzing situations of a current user and surroundings, such that the optimized specific audio service can be offered to a user.

Accordingly, a user can receive the optimized audio service by only wearing a headset, without a particular selection for a preferred audio service.

BRIEF DESCRIPTION OF THE DRAWINGS

The accompanying drawings, which are included to provide a further understanding of the invention, are incorporated in and constitute a part of this application, illustrate embodiments of the invention and together with the description serve to explain the principle of the invention. In the drawings.

BEST MODE FOR CARRYING OUT THE INVENTION

Reference will now be made in detail to the preferred embodiments of the present invention, examples of which are illustrated in the accompanying drawings.

Figure 1:
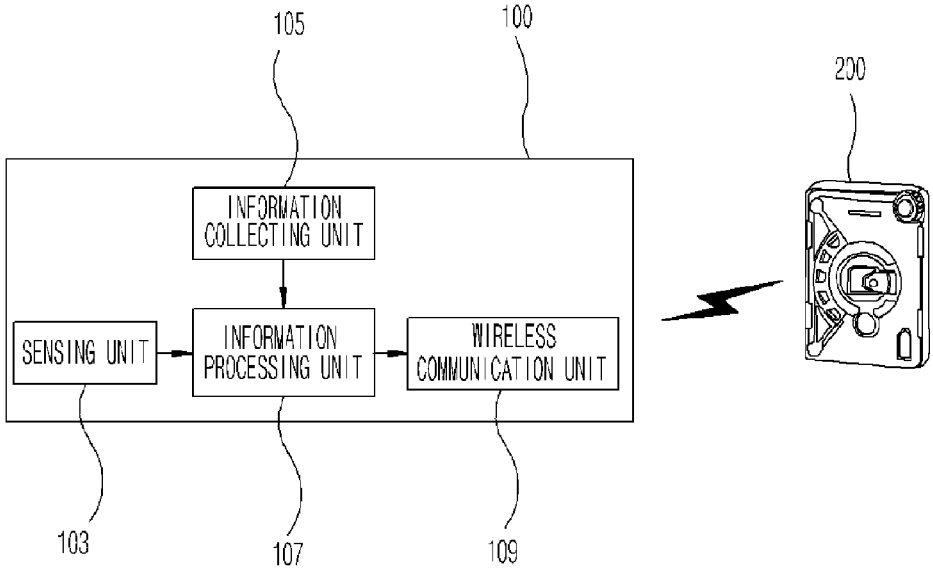
FIG. 1 illustrates a block diagram of a headset for a specific audio service according to an embodiment of the present invention.

FIG. 1 illustrates a block diagram of a headset for a specific audio service according to an embodiment of the present invention.

Referring to FIG. 1, an artificial headset 100 of the present invention includes a sensing unit 103, an information collecting unit 105, an information processing unit 107, and a wireless communication unit 109.

The sensing unit 103 senses whether or not the headset 100 is put on.

Preferably, the sensing unit 103 may include one of a temperature sensing unit, a light sensing unit, a gyro sensing unit, a pressure sensing unit, a skin conductivity sensing unit, and a pulse sensing unit.

The information collecting unit 105 collects information for whether or not the headset is put on and information for a current state of a user when the headset is put on.

Preferably, the information collecting unit 105 may include at least one of a temperature sensing unit, a light sensing unit, a gyro sensing unit, a pressure sensing unit, a skin conductivity sensing unit, and a pulse sensing unit.

The information processing unit 107 generates a user profile based on the current situation information of a user, and controls an audio signal output of a digital audio device 200 based on the generated user profile. As a result, a user specific audio service is possible. Here, the user profile includes types or lists of specific situation audio that a user prefers.

According to the embodiment of the present invention, the sensing unit 103 and the information collecting unit 105 are represented using respectively different terms due to their different functions. However, in an aspect of a structure, they substantially include an identical sensing unit, i.e., at least one of a temperature sensing unit, a light sensing unit, a gyro sensing unit, a pressure sensing unit, a skin conductivity sensing unit, and a pulse sensing unit.

The wireless communication unit 109 performs wireless communication between the headset 100 and the digital audio device 200. For example, if the headset 100 and the digital audio device 200 have a short-distance transmission/reception function, the headset 100 delivers types or lists of music that are the most appropriate for a user to the digital audio device 200 through an infrared communication method or a Bluetooth communication method, and this makes a user specific audio service possible.

Similarly, the wireless headset 100 determines its current situation by using the information collecting unit 105, and recognizes user's current situation through information exchange with the digital audio device 200.

The digital audio device 200 manages user's preferred music types of a particular situation in a form of a user profile.

When a user wants to listen to music, the present invention recognizes current situations of a user and surroundings and selects user's preferred music related to a current situation from the user profile to automatically provide music by simply wearing the headset without additional interventions.

In another embodiment, the information collecting unit 105 can be mounted on the headset 100 and the digital audio device 200. In this case, the present invention recognizes surrounding situations of a user and selects the optimized music for a user for listening through mutual information exchanges between the information collecting unit 105 of the headset 100 and a information collecting unit (not shown) of the digital audio device 200.

Figure 2:
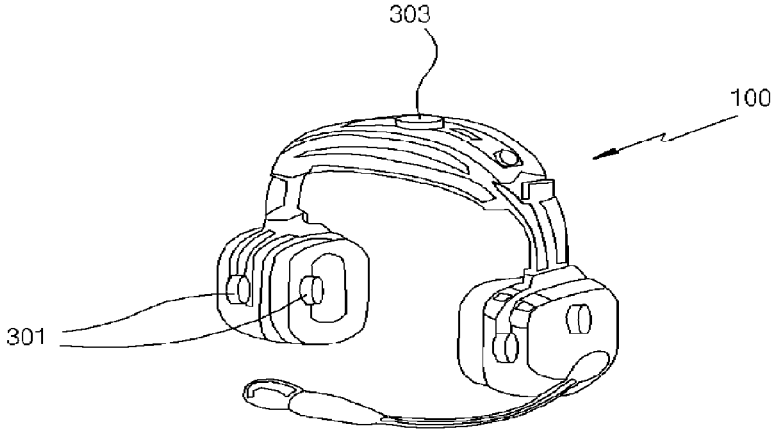
FIG. 2 illustrates a view of a sensing unit of a headset according to an embodiment of the present invention.

FIG. 2 illustrates a view of a sensing unit of a headset according to an embodiment of the present invention.

Referring to FIG. 2, the sensing unit of the headset 100 includes a temperature sensing unit 301 and an acceleration sensing unit 303. For example, the temperature 301 is mounted on the inner part that the ear contacts and the outer part of the headset 100.

When a user wears the headset 100, it is determined whether or not the headset 100 is put on using a temperature difference between the temperature detected through the temperature sensing unit 301 of the inner part that the ear contacts and the temperature detected through the temperature sensing unit of the outer part.

Similar to this, after attaching the light sensing unit on the same positions, it can be determined whether or not the headset 100 is put on using a light intensity difference between the inner part and the outer part.

Furthermore, the acceleration sensing unit 303 can recognize when the headset moves fast, and this movement may help the acceleration sensing unit 303 to determine whether or not the headset is put on.

The determining of whether or not the headset is put on may use a gyro sensing unit, a pressure sensing unit, a skin conductivity sensing unit, a pulse sensing unit, etc. except for the above sensing units.

The gyro sensing unit can detect a current a position of a wireless headset. The pressure sensing unit can detect that the portion that the ear contacts is pressed when a user wears a wireless headset. The skin conductivity sensing unit utilizes the electric conductivity difference caused by sweat in the portion that the ear contacts when a user wears a wireless headset. Additionally, the pulse sensing unit detects user's pulse cased by the portion that the ear contacts when a user wears a wireless headset.

As described above, those sensing units are selectively used in the headset of the present invention, and the headset entirely analyzes signals inputted from its sensing units to determine whether or not the headset is put on, or recognize situations of a user and surroundings.

Figure 3:
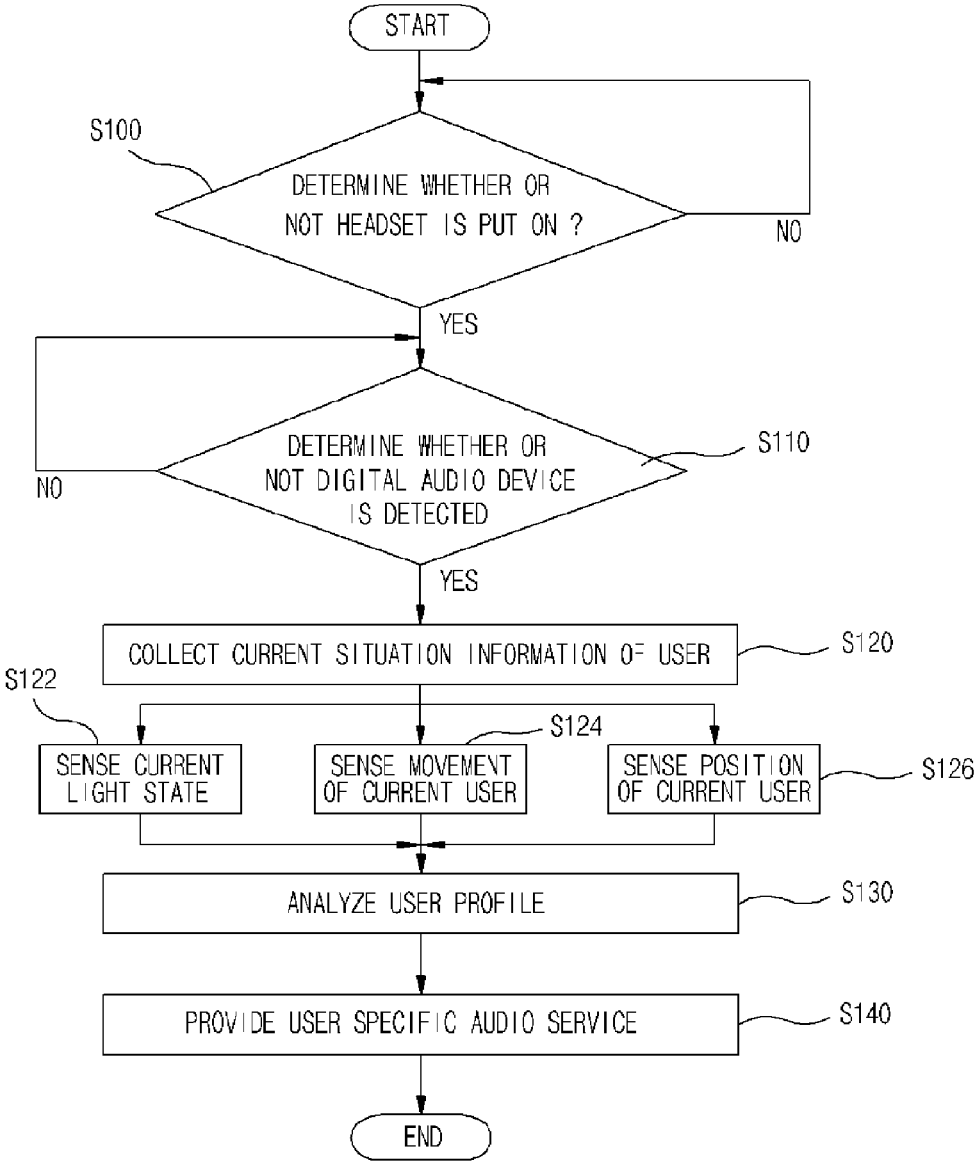
FIG. 3 illustrates a flowchart of a method for a specific audio service using a headset according to an embodiment of the present invention.

FIG. 3 illustrates a flowchart of a method for a specific audio service using a headset according to an embodiment of the present invention, and illustrates operations of recognizing situations of a user and surroundings after determining whether or not a user wears a wireless headset.

Referring to FIG. 3, it is determined whether or not a user wears a headset in operation S100. As described above, the determining of whether or not a user wears a headset is performed using sensing units of the headset.

In operation S110, when the user wears the headset, the present invention determines that the user wants an audio service and searches a digital audio device around the user.

In operation S120, when a digital audio player is detected around the user, current situation information of the user is collected.

The collecting of the current situation information is performed using sensing units of the headset or the digital audio device and for example, a light state related to a space of a current user is detected using a light sensing unit in operation S122. That is, it can be determined whether a user is located in a bright place or a dark place by using the light sensing unit.

Additionally, the acceleration sensing unit can recognize a moving state of a current user in operation S124. That is, it can be determined whether a user is walking, running, or resting.

Other than that, if there is a location sensing unit, it can be determined where a user currently is located in operation S126.

As described above, a state of a current user can be more accurately determined by analyzing information inputted from various sensing units. For example, when a user is running early morning at a park, it can be determined that the user is running at the outside.

Next, a user profile is analyzed based on the collected current situation information of a user in operation S120, and a user specific audio service is provided based on the analyzed user profile in operation S130.

That is, once the current situation information of the user is recognized, types or lists that are the most suitable for the current user are searched, and then are delivered to a digital audio device to make the user specific audio service possible. For this, indexing related to the user profile is required for types of user's preferred audio at each specific situation. This indexing can be obtained by learning the types of audio services, which are frequently provided from user specific situations.

It will be apparent to those skilled in the art that various modifications and variations can be made in the present invention. Thus, it is intended that the present invention covers the modifications and variations of this invention provided they come within the scope of the appended claims and their equivalents.

The invention claimed is:

1. A headset for a user specific audio service, comprising:

a sensing unit sensing whether or not the headset is put on;

an information collecting unit determining whether or not the headset is put on by the sensing unit and collecting current situation information of a user when the headset is put on; and an information processing unit generating a user profile based on the current situation information of the user, and controlling an audio signal output of a digital audio device based on the generated user profile.

2. The headset of claim 1, further comprising a wireless communication unit performing wireless communication.

3. The headset of claim 1, wherein the sensing unit comprises one of a temperature sensing unit, a light sensing unit, an acceleration sensing unit, a gyro sensing unit, a pressure sensing unit, a skin conductivity sensing unit, and a pulse sensing unit.

4. The headset of claim 1, wherein the information collecting unit is mounted on the digital audio device.

5. The headset of claim 1 or 4, wherein the information collecting unit comprises at least one of a temperature sensing unit, a light sensing unit, an acceleration sensing unit, a gyro sensing unit, a pressure sensing unit, a skin conductivity sensing unit, and a pulse sensing unit.

6. The headset of claim 1, wherein the user profile comprises types or lists of specific situation audio that the user prefers.

7. The apparatus of claim 1, wherein the sensing unit comprises:

a temperature sensing unit or a light sensing unit mounted on an inner part of the headset that the user's ear contacts and an outer part of the headset, wherein it is determined whether or not the headset is put on using a temperature difference between the temperature detected through the inner part and the temperature detected through the outer part or using a light intensity difference between the inner part and the outer part.

8. A method for a specific user audio service by using a headset, the headset outputting music appropriate for a user through wireless communication between the headset and a digital audio device, the method comprising the steps of:

determining whether or not the user wears the headset;

searching the digital audio device when the user wears the headset;

collecting current situation information of the user when the digital audio device is detected;

analyzing a user profile based on the collected current situation information of the user; and providing the user specific audio service based on the analyzed user profile.

9. The method of claim 8, wherein the current situation information of the user comprises at least one of a temperature sensing unit, a light sensing unit, an acceleration sensing unit, a gyro sensing unit, a pressure sensing unit, a skin conductivity sensing unit and a pulse sensing unit.

10. The method of claim 8, wherein the user profile comprises types or lists of specific situation audio that the user prefers.

11. A headset for a user specific audio service, comprising:

a sensing unit sensing whether or not the headset is put on;

an information collecting unit determining whether or not the headset is put on by the sensing unit and collecting current situation information of a user when the headset is put on; and an information processing unit generating a user profile based on the current situation information of the user, the current situation information including information about the user's surroundings, and controlling an audio signal output of a digital audio device based on the generated user profile.

12. The apparatus of claim 11, wherein the current situation information of a user includes light state information light indicating the amount of light detected in the user's surrounding.

13. The apparatus of claim 11, wherein the current situation information of the user includes acceleration information indicating a type of movement performed by the user.

14. The apparatus of claim 11, wherein the current situation information of the user includes location information indicating where the user is currently located.

15. The apparatus of claim 11, wherein the user profile includes types or lists of specific situation audio that the user prefers in a current situation of the user determined by the current situation information, and indexing of user's preferred audio at different situations is performed by the information processing unit.

* * * * *